US005535489A

United States Patent [19]

Cunagin et al.

[11] Patent Number: 5,535,489

[45] Date of Patent: Jul. 16, 1996

[54] SHIELD FOR BURIAL CASKET

[75] Inventors: Gary F. Cunagin, Tip City; Timothy L. Jerew, Marion; Allison B. Millikan, West Chester, all of Ohio; Patrick M. Saaf, Mancheter, N.H.

[73] Assignee: Batesville Casket Company, Inc., Batesville, Ind.

[21] Appl. No.: 489,502

[22] Filed: Jun. 12, 1995

[51] Int. Cl.[6] ..... A61G 17/00

[52] U.S. Cl. ..... 27/14; 27/20

[58] Field of Search ..... 27/1–2, 14, 17–20

[56] References Cited

U.S. PATENT DOCUMENTS

| | | | |
|---|---|---|---|
| 1,421,018 | 6/1922 | Mesker | 27/14 |
| 1,622,777 | 3/1927 | Fleeman | 27/7 |
| 2,579,756 | 12/1951 | Reed | 27/7 |
| 3,055,079 | 9/1962 | Flynn | 27/15 |
| 4,407,053 | 10/1983 | Ball | 27/14 |
| 4,780,940 | 11/1988 | Jay | 27/2 X |

*Primary Examiner*—Carl D. Friedman
*Assistant Examiner*—Beth A. Aubrey
*Attorney, Agent, or Firm*—Wood, Herron & Evans

[57] ABSTRACT

A combination casket and shield comprises a casket having a casket shell with a pair of side walls, a pair of end walls connecting the side walls and an interior. The shell walls include a groove therein extending peripherally around the interior of the casket shell. An elongated sealing strip is disposed in the casket shell groove and has first and second resilient sealing members. A transparent shield is removably installed to the shell. The shield has a peripheral edge retained between the first and second sealing members of the sealing strip in sealing engagement therewith. The sealing strip includes a third member disposed in the casket shell groove and the first and second members are connected to the third member. The first and second sealing members are hinged relative to one another by a resilient living hinge and include respective resilient interlocking projections. The projections are configured to releasably interlock when the first and second sealing members are moved toward one another, whereupon the peripheral edge of the transparent shield is removably retained therebetween.

16 Claims, 1 Drawing Sheet

SHIELD FOR BURIAL CASKET

FIELD OF THE INVENTION

This invention relates generally to burial caskets, and more particularly to a transparent shield for a burial casket installable onto the casket shell permitting viewing of the deceased but preventing the escape of contagion, odors and the like from the casket.

BACKGROUND OF THE INVENTION

For years caskets have been employed to present the remains of a deceased for viewing and payment of final respects to the deceased by acquaintances and loved ones, and for burial purposes. Modern body preservation techniques such as embalming and the like are employed to prevent decomposition of the body during the time after death and prior to burial when the body is presented for viewing and memorial services are conducted. In some countries, however, religious practices prevent such body preservation techniques from being utilized. Therefore it is desirable to provide some sort of transparent shield, sometimes termed a so-called "spirit shield", which seals to the casket shell to contain odors yet which allows for viewing of the deceased. And even in instances where modern body preservation techniques are employed, it may be desirable to employ such a shield to prevent the spread of contagion from the body to mourners.

The current practice when fitting a wooden casket with such a shield is to employ a wooden rail which is secured within the periphery of the interior of the casket shell by attachment to the casket shell side walls and end walls. The rail provides a flange or lip or seat for supporting thereatop the shield around its peripheral edge. In order to provide an effective seal between the shield and the casket shell walls, double-sided tape may be applied between the upper surface of the rail and the lower surface of the peripheral edge of the shield. Caulk may be applied between the peripheral edge of the shield and the casket walls. Screws may be employed to further secure the shield to the rail.

While such a construction is effective in sealing odors and the like within the casket, it is not without criticism. Once the shield is installed it is not readily removable, if it is removable at all. In many instances in which the body has been embalmed to preserve it but especially where the body has not been embalmed as in countries in which religious practices prevent embalming and the like it is often desirable or necessary to "touch up" the body for aesthetic purposes prior to burial. However, once the shield is installed semi-permanently or permanently as described above, such touching up is either not practical or is simply not possible. Accordingly, there is a need to provide a shield for a burial casket which provides an effective seal between the shield and the casket shell walls yet which is readily and easily installed and removed so that the body can be readily and quickly attended to as needed.

It is therefore a main objective of the present invention to provide a shield for a burial casket which provides an effective seal between the shield and the casket shell walls yet which is easily and quickly installed and removed.

SUMMARY OF THE INVENTION

The present invention attains this objective by providing a combination casket and shield. The casket has a casket shell having a pair of side walls, a pair of end walls connecting the side walls and an interior. The shell walls include a groove therein extending peripherally around the interior of the casket shell. An elongated sealing strip is disposed in the casket shell groove and has first and second resilient sealing members. A transparent shield is removably installed to the shell. The shield has a peripheral edge removably retained between the first and second sealing members of the sealing strip in sealing engagement therewith.

The sealing strip includes a third resilient member. The third member is disposed in the casket shell groove and the first and second sealing members are connected to the third member. The first and second sealing members are hinged relative to one another by a resilient living hinge. The living hinge is of a first stiffness and the balance of the sealing strip is of a second stiffness, the second stiffness being greater than the first stiffness. Alternatively the living hinge is of a first hardness and the balance of the sealing strip is of a second hardness, the second hardness being greater than the first hardness.

The first and second sealing members include respective resilient interlocking projections. The interlocking projections are configured to releasably interlock when the first and second sealing members are moved toward one another, whereupon the peripheral edge of the transparent shield is removably retained therebetween.

One of the first and second sealing members includes a foam strip thereon whereby when the peripheral edge of the transparent shield is positioned between the first and second sealing members the peripheral edge compresses the foam strip by the action of the other of the first and second sealing members upon the shield peripheral edge.

The main advantage of the present invention is that a shield for a burial casket is provided which provides an effective seal between the shield and the casket shell walls yet which is easily and quickly installed and removed.

These and other objects and advantages of the present invention will become more readily apparent during the following detailed description taken in conjunction with the drawings herein, in which:

DETAILED DESCRIPTION OF THE INVENTION

Figure 1:
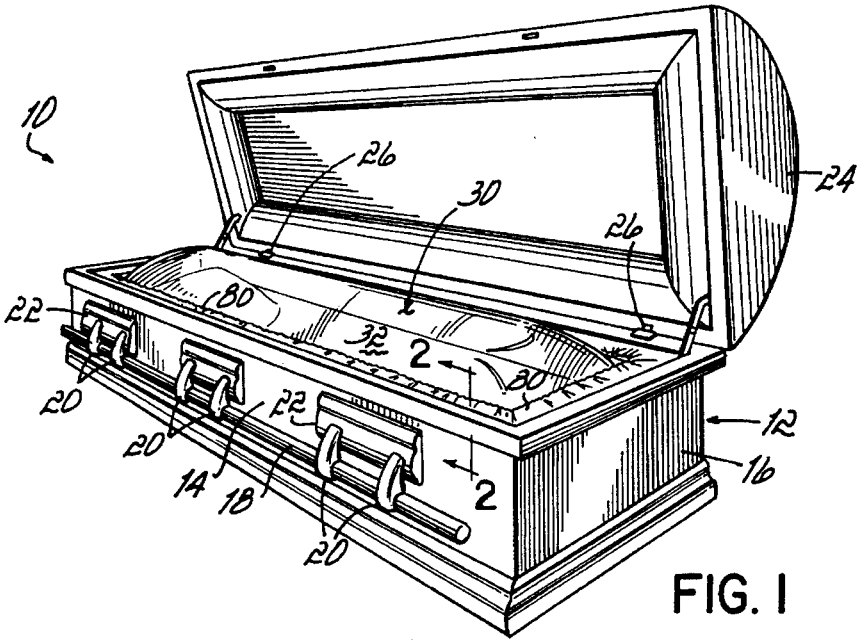
FIG. 1 is a perspective view of a casket and shield according to the principles of the present invention.

Referring first to FIG. 1, there is illustrated a casket 10 constructed according to the principles of the present invention. The casket 10 includes a lower shell 12 having a pair of side walls, one of which is shown at 14, and a pair of end walls connecting the side walls, one of which is shown at 16. Hardware in the form of an elongated handlebar 18 is attached to the side wall 14 through arms 20 and escutcheon plates 22. A lid 24 is hingedly connected to the shell 12 via hinges 26.

Figure 2:
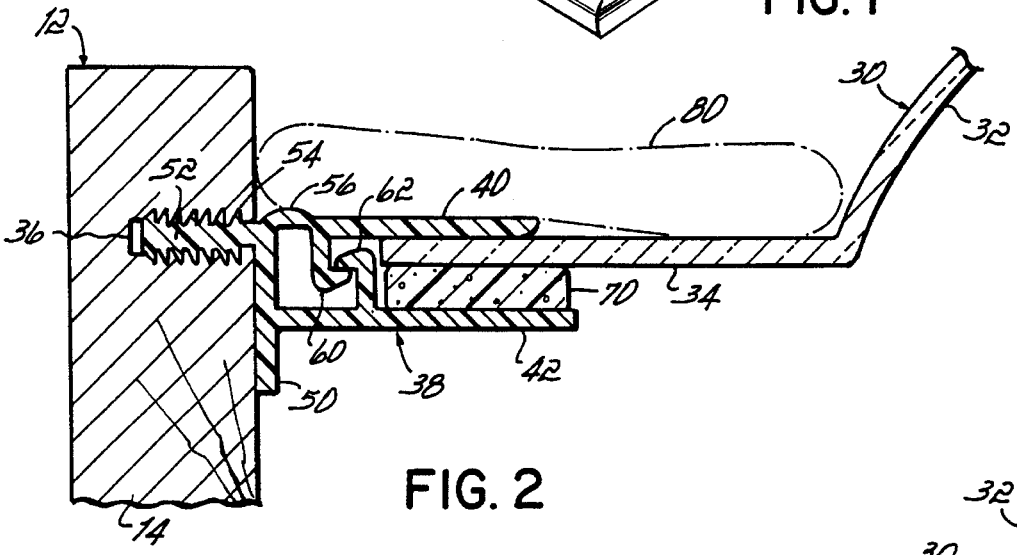
FIG. 2 is a view taken along line 2—2 of FIG. 1.
Figure 3:
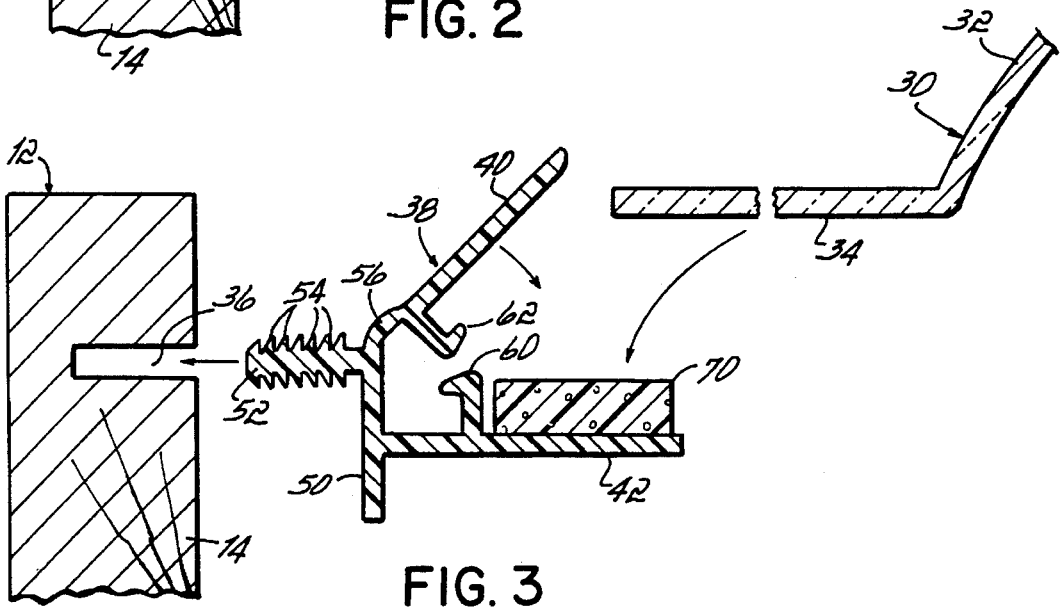
FIG. 3 is a view similar to FIG. 2 illustrating assembly of the shield into the casket.

Referring now to FIGS. 1–3, it will be seen that a transparent shield 30, fabricated of, for example, acrylic, is removably installed into the shell 12. The shield 30 includes a generally convex central portion 32 and a generally planar, horizontal peripheral edge 34 surrounding the convex portion 32. The shell side 14 and end 16 walls include a groove 36 therein extending peripherally around the interior of the casket shell 12 which, as illustrated, is fabricated of wood. An elongated sealing strip 38 is disposed in the casket shell groove 36. The elongated sealing strip 38 is preferrably fabricated of a resilient material, for example PVC, as an extrusion and includes first and second sealing members 40 and 42 respectively. The peripheral edge 34 of the shield 32 may be removably retained between the first and second sealing members 40 and 42 respectively in sealing engagement therewith as will be subsequently described in more detail.

Describing the elongated sealing strip 38 now in more detail, a generally vertically oriented (when installed in the shell 12) base portion 50 has connected thereto a member 52 in the form of a rib and including "Christmas tree" type projections 54 extending outwardly therefrom for press fitting into the groove 36. The first sealing member 40 is connected to the base 50 via a living hinge 56. Living hinge 56 is preferably of a softer, less stiff material than the balance of the resilient sealing strip 38. The material from which the living hinge 56 is fabricated is preferably a flexible PVC material known as GEON® C7000 available from the Geon Vinyl Division of B. F. Goodrich Company, Cleveland, Ohio. This flexible PVC material has an instantaneous hardness of 70 A points and a 100% modulus of 650 psi. The balance of the extruded sealing strip 38 is preferrably fabricated of a rigid PVC material known as GEON® 8700A available from the same company, which has a hardness-durometer D of 78 (±3) and a flexural modulus of 350,000 psi. The first and second sealing members 40 and 42 respectively include respective interlocking projections 60 and 62 which are configured to releasably interlock when the first and second sealing members 40 and 42 are moved toward one another, by way of moving or rotating the first member 40 toward the second member 42 facilitated by the living hinge 56 hinging the members 40 and 42 relative to one another.

The second sealing member 42 further preferably includes a foam strip 70 adhesively applied to an upper surface thereof. Thus, when the peripheral edge 34 of the transparent shield 30 is positioned between the first and second sealing members 40 and 42, the lower surface of the peripheral edge 34 compresses the foam strip 70 by the action of the first sealing member 40 upon the upper surface of the peripheral edge 34, thus affecting a generally air tight seal between the shield 30 and the casket shell 12.

In use, the foam strip 70 is first applied to the upper surface of second sealing member 42. Preferably, a foam strip including a single adhesive side is utilized to adhesively secure the strip 70 to the member 42. Next, one or more lengths of the resilient sealing strip 38 are affixed to the shell 12 around its periphery by press fitting the member 54 into the peripheral groove 36 in the interior of the shell 12. The peripheral edge 34 of the shield 30 is then placed atop the foam sealing strip 70, and the sealing member 40 is moved downwardly relative to the other sealing member 42 until the respective interlocking projections 60 and 62 interlock. Decorative fabric or the like 80 may be positioned peripherally about the shield 30 to conceal the strip 38 and foam 70. Decorative fabric 80 may be in the form of a "sock" with stuffing added thereto or alternatively decorative fabric 80 could be stapled to the rim of casket wall 12. Should access to the interior of the shell be desired, access may quickly be had by simply removing decorative material 80 and pulling the sealing member 40 upwardly so as to disengage interlocking projections 60 and 62 which may be repeatedly engaged and disengaged by hand due to the resilient nature of the PVC material.

Those skilled in the art will readily recognize numerous adaptations and modifications which can be made to the combination casket and shield of the present invention, yet all of which will fall within the spirit and scope of the invention as defined by the following claims. Accordingly, the invention is to be limited only by the scope of the following claims and their equivalents.

What is claimed is:

1. A combination casket and shield comprising:

a casket shell having a pair of side walls, a pair of end walls connecting said side walls and an interior;

said shell walls including a groove therein extending peripherally around said interior of said casket shell;

an elongated sealing strip disposed in said casket shell groove and having first and second resilient sealing members; and a transparent shield removably installed to said shell, said shield having a peripheral edge removably retained between said first and second sealing members of said sealing strip in sealing engagement therewith.

2. The combination of claim 1 wherein:

said sealing strip includes a third resilient member, said third member disposed in said casket shell groove, said first and second sealing members connected to said third member.

3. The combination of claim 2 wherein said first and second sealing members are hinged relative to one another by a resilient living hinge.

4. The combination of claim 3 wherein said living hinge is of a first stiffness and the balance of said sealing strip is of a second stiffness, said second stiffness being greater than said first stiffness.

5. The combination of claim 4 wherein said living hinge is of a first hardness and the balance of said sealing strip is of a second hardness, said second hardness being greater than said first hardness.

6. The combination of claim 3 wherein said first and second sealing members include respective resilient interlocking projections, said interlocking projections being configured to releasably interlock when said first and second sealing members are moved toward one another, whereupon said peripheral edge of said transparent shield is removably retained therebetween.

7. The combination of claim 6 wherein one of said first and second sealing members includes a foam strip thereon whereby when said peripheral edge of said transparent shield is positioned between said first and second sealing members said peripheral edge compresses said foam strip by the action of the other of said first and second sealing members upon said peripheral edge.

8. A combination casket and shield comprising:

a casket shell having a pair of side walls, a pair of end walls connecting said side walls and an interior;

said shell walls including a groove therein extending peripherally around said interior of said casket shell;

an elongated sealing strip disposed in said casket shell groove; and a transparent shield removably installed to said shell, said shield having a peripheral edge removably retained by said sealing strip in sealing engagement therewith;

said sealing strip comprising:

first and second sealing members retaining said peripheral edge therebetween;

a third member disposed in said shell groove, said first and second sealing members connected to said third member;

respective interlocking projections on said first and second sealing members configured to releasably interlock when said first and second sealing members are moved toward one another, whereupon said peripheral edge of said transparent shield is removably retained therebetween.

9. The combination of claim 8 wherein said first and second sealing members are hinged relative to one another by a resilient living hinge.

10. The combination of claim 9 wherein said living hinge is of a first stiffness and the balance of said sealing strip is of a second stiffness, said second stiffness being greater than said first stiffness.

11. The combination of claim 9 wherein said living hinge is of a first hardness and the balance of said sealing strip is of a second hardness, said second hardness being greater than said first hardness.

12. The combination of claim 11 wherein one of said first and second sealing members includes a foam strip thereon whereby when said peripheral edge of said transparent shield is positioned between said first and second sealing members said peripheral edge compresses said foam strip by the action of the other of said first and second sealing members upon said peripheral edge.

13. A combination casket and shield comprising:

a casket shell having a pair of side walls, a pair of end walls connecting said side walls and an interior;

said shell walls including a groove therein extending peripherally around said interior of said casket shell;

an elongated sealing strip disposed in said casket shell groove; and a transparent shield removably installed to said shell, said shield having a peripheral edge removably retained by said sealing strip in sealing engagement therewith;

said sealing strip comprising:

first and second resilient sealing members retaining said peripheral edge therebetween;

a third resilient member disposed in said shell groove, said first and second sealing members connected to said third member;

respective resilient interlocking projections on said first and second sealing members configured to releasably interlock when said first and second sealing members are moved toward one another, whereupon said peripheral edge of said transparent shield is removably retained therebetween; and a foam strip on one of said first and second sealing members whereby when said peripheral edge of said transparent shield is positioned between said first and second sealing members said peripheral edge compresses said foam strip by the action of the other of said first and second sealing members upon said peripheral edge.

14. The combination of claim 13 wherein said first and second sealing members are hinged relative to one another by a resilient living hinge.

15. The combination of claim 14 wherein said living hinge is of a first stiffness and the balance of said sealing strip is of a second stiffness, said second stiffness being greater than said first stiffness.

16. The combination of claim 14 wherein said living hinge is of a first hardness and the balance of said sealing strip is of a second hardness, said second hardness being greater than said first hardness.

* * * * *